US008734099B2

(12) United States Patent
Takarai

(10) Patent No.: US 8,734,099 B2
(45) Date of Patent: May 27, 2014

(54) WATER PUMP FOR VEHICLE AND BEARING STRUCTURE

(75) Inventor: Kenya Takarai, Honjo (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 653 days.

(21) Appl. No.: 12/969,703

(22) Filed: Dec. 16, 2010

(65) Prior Publication Data

US 2011/0150630 A1 Jun. 23, 2011

(30) Foreign Application Priority Data

Dec. 18, 2009 (JP) ..... 2009-287886

(51) Int. Cl.
*F04D 29/04* (2006.01)

(52) U.S. Cl.
USPC ..... 415/206

(58) Field of Classification Search
USPC ..... 415/142, 170.1, 206, 230; 384/477, 384/480, 484, 488; 417/362
See application file for complete search history.

(56) References Cited

U.S. PATENT DOCUMENTS 4,955,786 A 9/1990 Kunkel et al.
7,311,499 B2 * 12/2007 Hattori et al. ..... 416/170 R

FOREIGN PATENT DOCUMENTS

| | | | |
|---|---|---|---|
| FR | 2693514 | * | 1/1994 |
| JP | 2-055899 | | 2/1990 |
| JP | 2004-176666 | | 6/2004 |
| JP | 2004-293467 | * | 10/2004 |
| JP | 2005-299610 | | 10/2005 |
| JP | 2008-121502 | | 5/2008 |

OTHER PUBLICATIONS

Baglin, Improved centrifugal pump for use in heat engines, Jan. 14, 1994, Abstract of FR 2693514.*
Koga, Water Pump, Oct. 21, 2004, Abstract of JP 2004-293467.*

* cited by examiner

*Primary Examiner* — Ned Landrum
*Assistant Examiner* — Liam McDowell
(74) *Attorney, Agent, or Firm* — Antonelli, Terry, Stout & Kraus, LLP.

(57) ABSTRACT

A water pump for a vehicle includes: a pump housing; a drive shaft; an impeller fixed on a first end portion of the drive shaft; a pulley including a first radial extension portion and a first axial extension portion; a seal ball bearing which is disposed between an inner circumference surface of the first axial extension portion and an outer circumference surface of a cylindrical portion, and which includes seal members; and a plate member disposed between an end portion of the seal ball bearing which is on an impeller side and a stepped portion, and arranged to cover an end surface of the seal ball bearing which is on the impeller side, the plate member having a thickness smaller than a thickness of the stepped portion, and including a separating portion which is separated from a portion rotating relative to the plate member.

12 Claims, 6 Drawing Sheets

WATER PUMP FOR VEHICLE AND BEARING STRUCTURE

BACKGROUND OF THE INVENTION

This invention relates to a water pump which is applied to an engine cooling system for a vehicle, and which is arranged to circulate a coolant water in the engine cooing system.

A Japanese Patent Application Publication No. 2004-176666 discloses a conventional water pump including a substantially cylindrical pump housing including one end portion fixed on an outer portion of an engine block; a pulley rotatably supported through a ball bearing on an outer circumference of a supporting portion which is formed on the other end side of the pump housing, and which has a stepped portion formed so that a diameter is decreased, and connected through a belt with an output shaft of an engine; a shaft portion which is formed at a central portion of the pulley, which protrudes in the axial direction, and which is integrally formed with the pulley; and an impeller which is fixed on an end portion of the shaft portion, which is arranged to rotate as a unit with the shaft portion, and which is received in the inner circumference portion of the one end portion of the pump housing. The impeller is arranged to be rotated by the rotational driving force of the engine which is transmitted through the pulley to the shaft portion.

This water pump employs, as a ball bearing, a seal ball bearing having seal members arranged to liquid-tightly hold between an inner wheel and an outer wheel of the ball bearing, so as to keep a bearing ability of the ball bearing even when the water pump is exposed to the rainwater, the condensation, and so on. However, when a water with a dust is adhered to the seal member, the seal ability of the seal ball bearing may be deteriorated. In this water pump, the end surface of the stepped portion formed at the base end portion of the support member to which the inner wheel is fixed covers the seal member disposed at an end portion of the ball bearing which is on the engine side, and to which the water tends to adhered. With this, it is possible to improve the endurance of the seal member.

SUMMARY OF THE INVENTION

However, in the conventional water pump, the stepped portion is formed by the drawing. Accordingly, it is difficult to control an axial distance between a tip end and a base end of the support member, that is, to control the position of the stepped portion. When the distance between the end surface of the ball bearing which is on the engine side and the end surface of the stepped portion is large, the water is stored in a portion between the end surface of the bearing which is on the engine side and the end surface of the stepped portion. Moreover, when the distance between the end surface of the bearing which is on the engine side and the end surface of the stepped portion is small, the seal member contacts the end surface of the stepped portion. The seal member is worn.

It is, therefore, an object of the present invention to provide a water pump for a vehicle which is devised to solve the above described problems, and to readily improve endurance of a seal member of a seal ball bearing.

According to one aspect of the present invention, a water pump for a vehicle, the water pump comprises: a pump housing; a drive shaft which is inserted into the pump housing, and which includes an axial portion surrounded by the pump housing; an impeller fixed on a first end portion of the drive shaft, and arranged to discharge a fluid sucked from an axial direction, in a radial direction by rotating by a centrifugal force; a pulley arranged to transmit a rotational driving force from an outside to the drive shaft, the pulley including; a fixing portion fixed on a second end portion of the drive shaft, a first radial extension portion which is connected with the fixing portion, and which extends radially outside the drive shaft, and a first axial extension portion which is connected with the first radial extension portion, and which extends in the axial direction toward the first end side of the drive shaft; a seal ball bearing which is disposed between an inner circumference surface of the first axial extension portion and an outer circumference surface of a cylindrical portion that is formed at a first end portion of the pump housing, and that confronts the inner circumference surface of the first axial extension portion, and which includes seal members located at both axial ends of the seal ball bearing in the axial direction, and arranged to liquid-tightly seal an inside of the seal ball bearing; and a plate member disposed between an end portion of the seal ball bearing which is on an impeller side and a stepped portion which is adjacent to the cylindrical portion, and arranged to cover an end surface of the seal ball bearing which is on the impeller side, the plate member having a thickness smaller than a thickness of the stepped portion, and including a separating portion which is separated from a portion rotating relative to the plate member.

According to another aspect of the invention, a water pump for a vehicle, the water pump comprises: a driving rotation section including an impeller arranged to discharge a fluid sucked from an axial direction, in a radial direction by rotating by a centrifugal force; a pump housing covering the driving rotation section; a seal ball bearing including an inner wheel disposed on one of the driving rotation section and the pump housing, an outer wheel disposed on the other of the driving rotation section and the pump housing, a plurality of balls disposed between the inner wheel and the outer wheel, and arranged to be rolled between the inner wheel and the outer wheel, and seal members which are disposed on both axial ends of one of the inner wheel and the outer wheel, and which extend in the radial direction toward the other of the inner wheel and the outer wheel; and a plate member which is disposed between one of the inner wheel and the outer wheel and the pump housing, and which covers at least an end portion of a first end side of the seal ball bearing in the axial direction, the plate member having a thickness smaller than a thickness of a stepped portion, and including a separating portion bent to separate the plate member from a portion rotating relative to the plate member.

According to still another aspect of the invention, a bearing structure comprises: an inner wheel disposed on one of a first cylindrical member and a second cylindrical member; an outer wheel disposed on the other of the first cylindrical member and the second cylindrical member; a plurality of balls disposed between the inner wheel and the outer wheel, and arranged to be rolled between the inner wheel and the outer wheel; seal members which are disposed on both axial ends of one of the inner wheel and the outer wheel, and which extend in the radial direction toward the other of the inner wheel and the outer wheel; and a plate member which covers at least an end portion on one end side of the axial direction between the inner wheel and one of the first cylindrical member and the second cylindrical member, and which is separated from the outer wheel and the seal member.

DETAILED DESCRIPTION OF THE INVENTION

Hereinafter, water pumps for a vehicle according to embodiments of the present invention are illustrated with reference to drawings. The water pumps according to the embodiments are applied to a conventional cooling system for an engine of the vehicle. These water pumps are disposed on a side surface of an engine block. The water pumps are arranged to circulate a cooling water (coolant water) within the engine block by a rotating driving force of a crank shaft of the engine.

Figure 1:
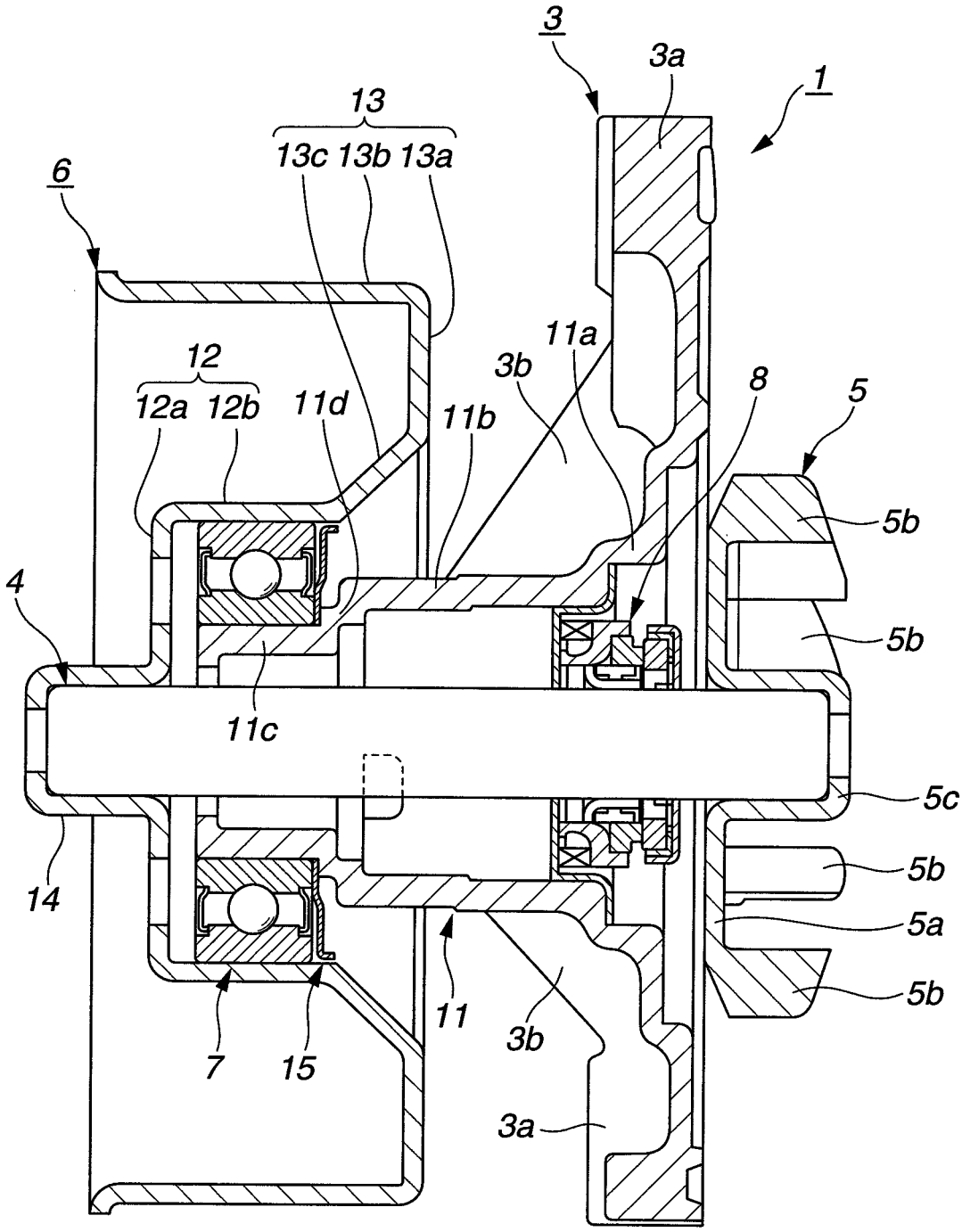
FIG. 1 is a longitudinal cross sectional view showing a water pump for a vehicle according to a first embodiment of the present invention.
Figure 2:
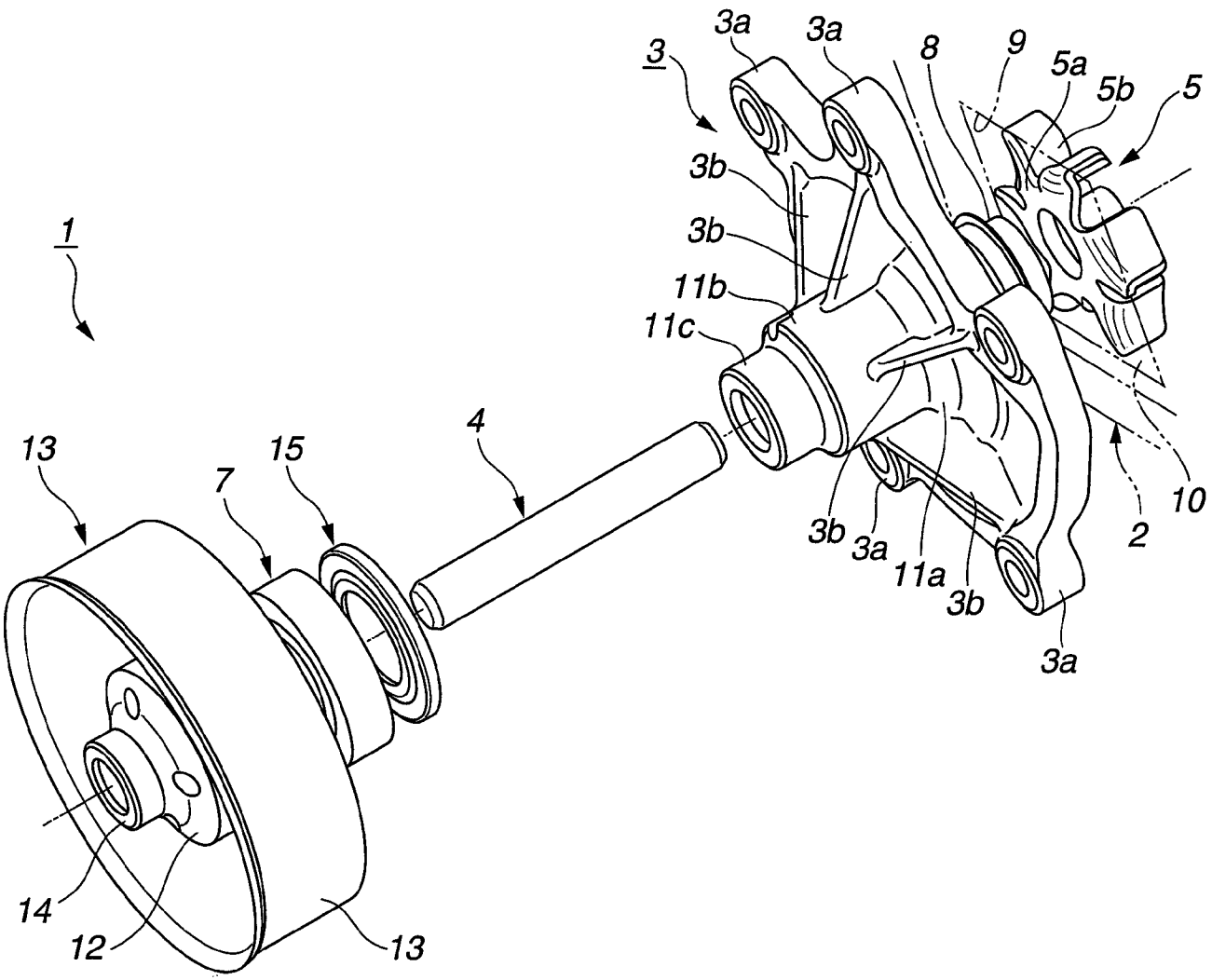
FIG. 2 is an exploded perspective view showing the water pump structure of FIG. 1.

FIGS. 1-4 show a water pump according to a first embodiment of the present invention. As shown in FIGS. 1 and 2, this water pump 1 includes a pump housing 3 which is formed into a substantially cylindrical shape, which includes a cylindrical portion 11 having a stepped shape formed so that a diameter is decreased in an axial direction toward a first end side (left end side in FIG. 1) of pump housing 3, and which is fixed on a side surface of an engine block 2 shown by a broken line in FIG. 2 through a flange portion 3*a* formed in a second end portion of pump housing 3 to define a pump chamber 10 which is a volute chamber between engine block 2 and pump housing 3; a drive shaft 4 which is disposed radially within pump housing 3, which extends in the axial direction within pump housing 3, and which includes a substantially axial central portion surrounded by pump housing 3; an impeller 5 fixed on an outer circumference portion of a first end portion (on a right side in FIG. 1) of drive shaft 4 which extends from the second end side of pump housing 3 to a pump chamber 10, and rotatably received within pump chamber 10; a pulley 6 formed into a substantially cylindrical shape, fixed on an outer circumference of a second end portion (on a left side in FIG. 1) of drive shaft 4 which extends from the first end side of pump housing 3 to the outside, and arranged to transmit the rotational driving force of the crank shaft through a belt (not shown) to drive shaft 4; and a seal ball bearing or sealed ball bearing 7 which has seals, which is disposed between pulley 6 and the first end portion of pump housing 3, which rotatably supports pulley 6, and which indirectly supports drive shaft 4 through pulley 6. In this case, a driving rotation section is constituted by drive shaft 4, impeller 5 and pulley 6 which rotate as a unit by receiving the rotational driving force of the crank shaft.

Pump housing 3 is formed by an aluminum die casting. Pump housing 3 includes a plurality of ribs 3*b* each of which has a substantially triangle cross section, which are arranged on the outer circumference portion on the flange 3*a*'s side of cylindrical portion 11 at predetermined intervals in a circumference direction, and which are raised to stand in the substantially axial direction of drive shaft 4. With this, it is possible to decrease a weight of pump housing 3 by further decreasing a thickness of pump housing 3, and also to ensure a predetermined strength of pump housing 3. Moreover, cylindrical portion 11 includes a large diameter portion 11*a* located adjacent to flange portion 3*a*; a middle diameter portion 11*b* connected with large diameter portion 11*a*, and formed in a substantially central portion of cylindrical portion 11 in the axial direction; and a small diameter portion 11*c* which is connected through a stepped portion 11*d* with middle diameter portion 11*b*, and which is formed at a tip end portion of cylindrical portion 11, and which correspond to a cylindrical portion. At an end portion of middle diameter portion 11*b* which is on the large diameter portion 11*a*'s side, a mechanical seal 8 is disposed between an inner circumference surface of middle diameter portion 11*b* and an outer circumference surface of drive shaft 4 which confronts the inner circumference surface of middle diameter portion 11*b*. Mechanical seal 8 is arranged to suppress a flow of the cooling water within pump chamber 10 to the small diameter portion 11*c*'s side.

Impeller 5 is integrally molded by pressing (forging) a metal sheet. Impeller 5 includes a base portion 5*a* formed into a substantially disc shape; a plurality of blade portions 5*b* which are bent in the axial direction by cutting and raising from the outer circumference portion of base end portion 5*a* at predetermined circumference positions, and a cylindrical shaft portion 5*c* formed in a central portion of base portion 5*a*, and recessed in the axial direction from the pump housing 3's side to the engine block 2's side. Shaft portion 5*c* is mounted on the outer circumference of the first end portion of drive shaft 4 by press fit, so that impeller 5 is fixed on drive shaft 4. Engine block 2 includes a suction port 9 formed in a side portion of engine block 2 to direct toward a substantially central portion of impeller 5, and arranged to suck the cooling water flowing within engine block 2. Moreover, there is formed a discharge opening (not shown) formed in a side portion of pump chamber 10, and arranged to discharge the cooling water urged by the centrifugal force generated by the rotation of impeller 5.

Pulley 6 is integrally formed into a substantially cylindrical shape by pressing (forging) a metal sheet. Pulley 6 includes a boss portion 12 formed into a substantially cylindrical shape with a cover; a belt winding portion 13 which extends radially outside boss portion 12, and which has an outer circumference around which the belt is wound; and a fixing portion 14 which is formed at a central portion of a first radial extension portion 12*a* (described later) of boss portion 12, and which is recessed in the axial direction from the pump housing 3's side toward the pulley 6's side. Fixing portion 14 is mounted on the outer circumference of the second end portion of drive shaft 4 by the press fit, so that pulley 6 is fixed on drive shaft 4.

Figure 3:
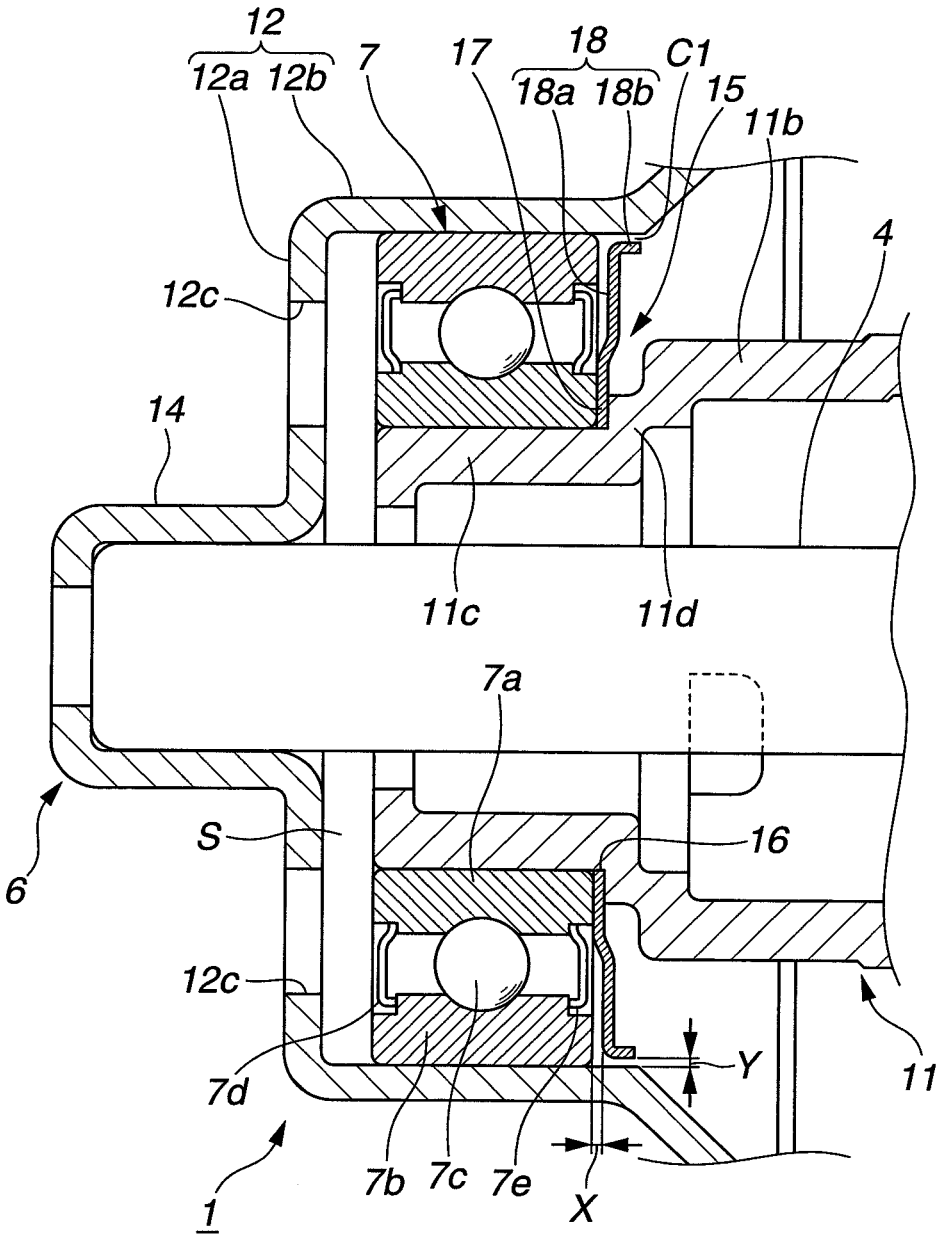
FIG. 3 is an enlarged view showing a main part of the water pump of FIG. 1.

As shown in FIG. 3, boss portion 12 includes first radial extension portion 12*a* which is connected with fixing portion 14, and which extends in the radially outward direction relative to drive shaft 4; and a first axial extension portion 12*b* which is connected with first radial extension portion 12*a*, and which extends in the axial direction toward the first end side of drive shaft 4. First radial extension portion 12*a* includes a plurality of through holes 12*c* formed at predetermined circumferential positions. The water entering into a space S formed between first radial extension portion 12*a* and bearing 7 can be discharged through through holes 12*c* to the outside. These through holes 12*c* are not formed in the outer circumference portion (radially outer portion) of first radial extension portion 12*a*. These through holes 12*c* are formed in a substantially radially central portion of first radial extension portion 12*a*. With this, it is possible to store a predetermined amount of the water within space S. Moreover, when an amount of the water within space S exceeds this predetermined amount, it is possible to discharge the water within space S through through holes 12*c* to the outside. With this, it is possible to discharge the water entering into space S so as not to adversely influence bearing 7, while suppressing the water from entering from the outside.

As shown in FIG. 1, belt winding portion 13 includes a second radial extension portion 13*a* which is connected with first axial extension portion 12*b*, and which extends in the radially outward direction relative to first axial extension portion 12*b*; and a second axial extension portion 13*b* which is connected with second radial extension portion 13*a*, and which extends in the axial direction toward the second end side of drive shaft 4. Second radial extension portion 13*a* and first axial extension portion 12*b* are connected by a taper connection portion 13*c* formed into a substantially conical shape.

As shown in FIG. 3, seal ball bearing 7 is disposed between an outer circumference surface of small diameter portion 11*c* and an inner circumference surface of first axial extension portion 12*b*. Seal ball bearing 7 includes an inner wheel 7*a* fixed on small diameter portion 11*c* by the press fit; an outer wheel 7*b* fixed in first axial extension portion 12*b* by the press fit; a plurality of balls 7*c* which are rolling members, and each of which is held in a pair of holding grooves (receiving portion) that are formed in outer wheel 7*b* and in inner wheel 7*a* to confront each other; substantially circular first and second seal member 7*d* and 7*e* which are fixed on both (axial) end portions of an inner circumference surface of outer wheel 7*b*, and which shut off a connection between the outside and a cylindrical space defined radially between inner wheel 7*a* and outer wheel 7*b*. In seal ball bearing 7, by first and second seal members 7*d* and 7*e*, it is possible to seal (enclose) the grease for smoothing the rolling movement of balls 7*c* within the cylindrical space of seal ball bearing 7, and to suppress the water from entering from the outside into the cylindrical space of seal ball bearing 7. With this, for example, first seal member 7*d* of bearing 7 which is disposed at a first end portion (on the left side of FIG. 3) of bearing 7 is arranged to hold, within the cylindrical space, the grease sealed within the cylindrical space. Moreover, first seal member 7*d* is arranged to suppress, from entering the cylindrical space, the water which can not be suppressed by mechanical seal 8, and which enters space S through the inner circumference portion of cylindrical portion 11, and the water entering space S from the outside through through holes 12*c*.

Figure 4:
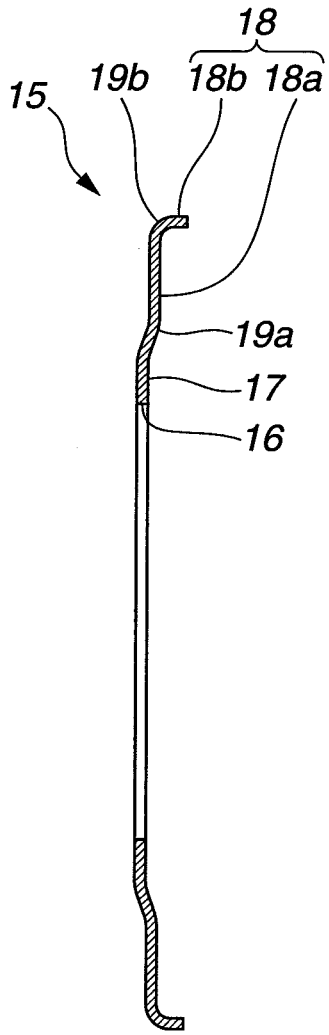
FIG. 4 is a longitudinal sectional view showing a cover plate shown in FIG. 3.

A cover plate (plate member) 15 is disposed on the second end surface (on the right side of FIG. 3) of seal ball bearing 7, adjacent to the second end surface of seal ball bearing 7. This cover plate 15 covers almost the entire second end surface of bearing 7. That is, as shown in FIGS. 3 and 4, cover plate 15 is formed into a substantially circular (annular) shape by pressing a metal sheet having a thickness smaller than a thickness of stepped portion 11*d* of cylindrical portion 11. Cover plate 15 includes a through hole 16 which is formed at a substantially central portion of cover plate 15, and which penetrates through cover plate 15. Cover plate 15 is mounted on the outer circumference surface of small diameter portion 11*c* through through hole 16. Moreover, cover plate 15 includes a base portion 17 formed in a portion radially outside through hole 16, and formed into a flat shape. Base portion 17 is sandwiched between the second end surface of inner wheel 7*a* of bearing 7 and a side surface of stepped portion 11*d* of cylindrical portion 11, so that cover plate 15 is fixed. In this way, cover plate 15 is sandwiched and fixed by inner wheel 7*a* of bearing 7 and stepped portion 11*d* of cylindrical portion 11. With this, there is no need for a special fixing means for fixing cover plate 15 such as the press fit on the outer circumference of small diameter portion 11*c*. Accordingly, it is possible to improve the workability of mounting (assembling) operation of pump 1.

Cover plate 15 includes a separating portion 18 which is formed at a portion radially outside base portion 17, and which is bent to be apart (separated) from pulley 6, outer wheel 7*b* and second seal member 7*e* of bearing 7 which rotate relative to cover plate 15. This separating portion 18 includes a first separating portion 18*a* which is connected with base portion 17, and which is bent so as to be offset to the first end side (impeller 5's side) of drive shaft 4 relative to base portion 17; and a second separating portion 18*b* which is connected with first separating portion 18*a*, and which is formed by bending the outer circumference portion of first separating portion 18*a* on the impeller 5's side so as to extend along the shape (the inner circumference) of boss portion 12 of pulley 6. That is, first separating portion 18*a* extends substantially parallel with the second end surface of bearing 7 through a first bending portion 19*a* formed into a substantially crank shape by bending the outer circumference portion of base portion 17. With this, first separating portion 18*a* is apart from outer wheel 7*b* and second seal member 7*e* in the axial direction by a predetermined distance X. Second separating portion 18*b* extends substantially parallel with the inner circumference surface of first axial extension portion 12*b* through a second bending portion 19*b* which is formed by bending, at the right angle, the outer circumference portion of first separating portion 18*a* which is an outermost circumference portion of cover plate 15 along first axial extension portion 12*b* toward the impeller 5's side. With this, second separating portion 18*b* is separated (deviated) from pulley 6 in the radial direction by a predetermined distance Y, FIG. 3, while keeping the predetermined separating distance X with respect to bearing 7.

In the thus-constructed water pump 1 for the vehicle, a portion of pump housing 3 which is on the flange portion 3*a*'s side is exposed to the outside. The rainwater and sweat (a drop of the water) by condensation and so on adhered on the outer side surface of flange portion 3*a* and the outer circumference surface of the base end side of cylindrical portion 11 flow along the outer circumference surface of cylindrical portion 11 to the bearing 7's side. However, in water pump 1 according to the first embodiment, cover plate 15 covers almost the entire second end surface of bearing 7. Accordingly, second seal member 7*e* disposed at the second end portion of bearing 7 is not exposed directly to the rainwater and so on. Therefore, it is possible to suppress the rainwater and so on from adhering to second seal member 7*e*, and thereby to improve the endurance (durability) of second seal member 7*e*.

Moreover, cover plate 15 is a component (member) different from pump housing 3. With this, it is possible to decrease a thickness of cover plate 15 relative to the thickness of stepped portion 11*d* of cylindrical portion 11. Furthermore, cover plate 15 has the thickness smaller than the thickness of stepped portion 11*d* of cylindrical portion 11. Accordingly, it is possible to readily perform the press work, to improve a productivity of pump 1, and to minimize (suppress) an increase of an axial size of pump 1.

In this way, cover plate 15 has the small thickness. With this, a rigidity of cover plate 15 may be decreased, and the outer circumference side of base portion 17 may be tend to vibrate. However, in water pump 1 according to the first embodiment, cover plate 15 includes separating portion 18 formed at a portion radially outside base portion 17. Accordingly, even when the outer circumference side of base portion 17 is vibrated by the vibration of the engine and pump 1 itself, it is possible to absorb this vibration by predetermined separating distances X and Y of separating portion 18. With this, it is possible to suppress the contact between cover plate 15 and portions which confront separating portion 18, and which rotate relative to cover plate 15. That is, first separating portion 18*a* suppresses the contact between first separating portion 18*a* (cover plate 15), and outer wheel 7*b* and second seal member 7*e* which confront first separating portion 18*a*. Second separating portion 18*b* suppresses the contact between second separating portion 18*b* (cover plate 15), and first axial extension portion 12*b* which confronts second separating portion 18*b*. With this, it is possible to suppress an increase of sliding resistance caused by the contact between cover plate 15 and the relative rotating portion (outer wheel 7*b* and second seal member 7*e* of bearing 7, and pulley 6) which rotate relative to cover plate 15. Accordingly, it is possible to prevent the deterioration of the bearing ability of (bearing performance) of bearing 7 by the breakage of bearing 7, and to prevent the decrease of the endurance of second seal member 7*e* by the abrasion of second seal member 7*e*.

Moreover, cover plate 15 has the small thickness, as described above. Accordingly, it is possible to ease dimensional control of cover plate 15 at the press forming (press molding). Furthermore, it is possible to ease dimensional control of predetermined separating distances X and Y of separating portion 18, and to decrease the manufacturing cost of pump 1.

Moreover, in water pump 1, separating portion 18 is formed by bending a plurality of portions of the outer circumference portion of cover plate 15 at first and second bending portions 19*a* and 19*b*. With this, it is possible to improve the rigidity of cover plate 15 and to further suppress the deformation of cover plate 15 which tends to deform due to the small thickness.

Moreover, the outermost circumference portion of cover plate 15 is bent at second bending portion 19*b* so as not to contact pulley 6, as described above. With this, there is formed a radial clearance C1 between first axial extension portion 12*b* of pulley 6 and second separating portion 18*b*. However, second separating portion 18*b* is bent along the shape (the inner circumference) of boss portion 12 of pulley 6 toward the impeller 5's side. Second separating portion 18 is formed so as to extend in a direction opposite to (adverse to) the entering direction of the rainwater and so on. Accordingly, it is possible to effectively suppress the rainwater and so on from entering through radial clearance C1, relative to a case in which second separating portion 18*b* is bent toward the bearing 7's side in a direction along the entering direction of the rainwater and so on.

Moreover, second separating portion 18*b* does not extend perpendicular to first axial extension portion 12*b* of pulley 6. Second separating portion 18*b* is bent to extend along first axial extension portion 12*b*. With this, it is possible to extend (lengthen) radial clearance C1 in the axial direction. Accordingly, it is possible to further suppress the rainwater and so on from entering through radial clearance C1.

Moreover, second seal member 7*e* is fixed on outer wheel 7*b*'s side of bearing 7. On the other hand, cover plate 15 is fixed on inner wheel 7*a*'s side of bearing 7. Cover plate 15 and second seal member 7*e* are alternatively arranged in the axial direction. With this, in cover plate 15, there is radial clearance C1 on the outer circumference side. In second seal member 7*e*, there is a radial clearance on the inner circumference side. That is, by the above-described structure, a passage through which the rainwater and so on enters from the second end side of bearing 7 has a labyrinth structure. Therefore, it is possible to further effectively suppress the rainwater and so on from entering the inside of bearing 7.

Figure 5:
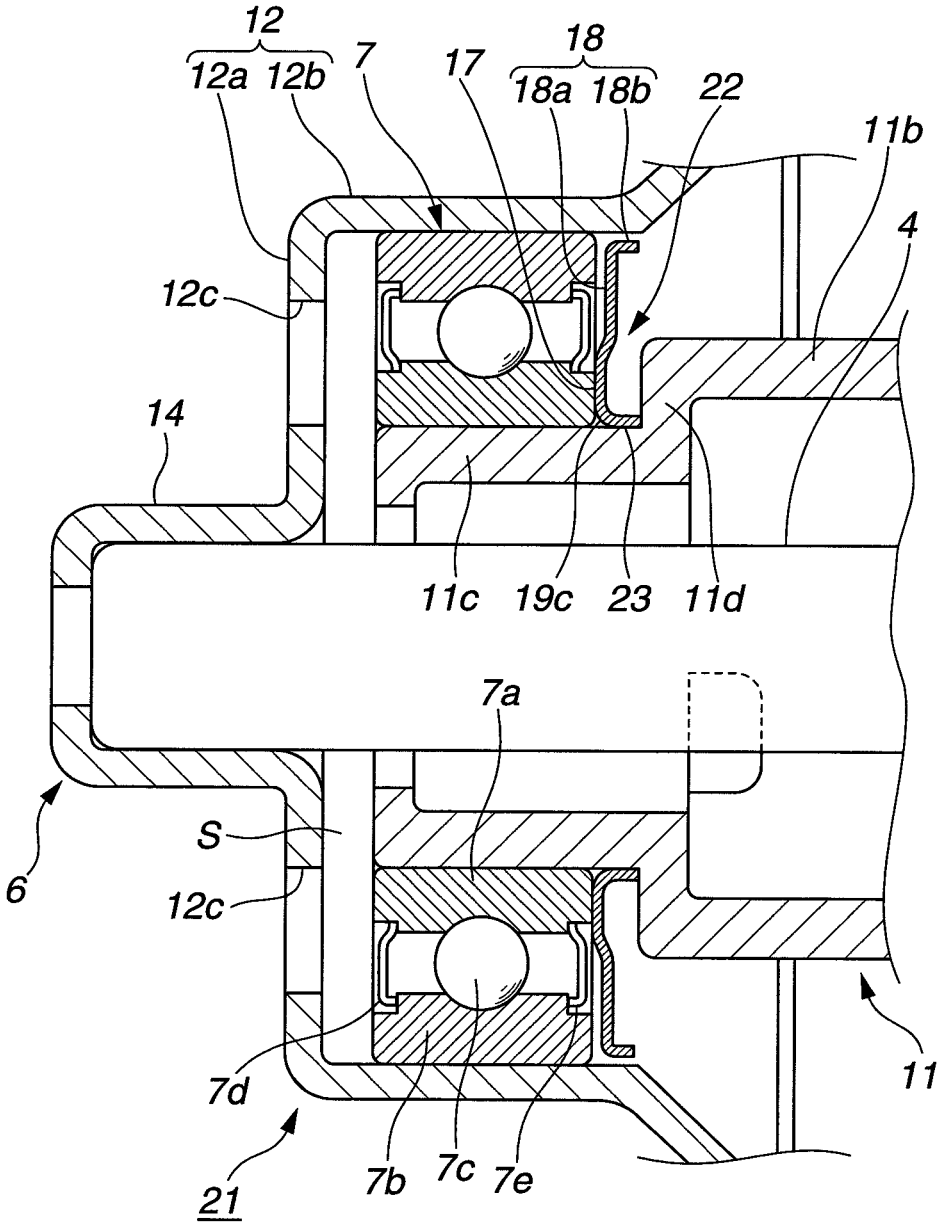
FIG. 5 is an enlarged view showing a main part of a water pump for a vehicle according to a second embodiment of the present invention.

FIG. 5 is a water pump 21 according to a second embodiment of the present invention. In water pump 21 according to the second embodiment, a shape of a cover plate 22 is changed from the shape of cover plate 15 in the first embodiment. Structures of water pump 21 other than cover plate 22 are substantially identical to water pump 1 according to the first embodiment in most aspects as shown by the use of the same reference numerals.

Cover plate 22 includes a press-fit fixing portion 23 which is formed into a substantially cylindrical shape, which is formed on the inner circumference side (radially inner side) of base portion 17 through a third bending portion 19*c* formed by bending, at the right angle, the innermost circumference portion of cover plate 15 of the first embodiment along the outer circumference surface of small diameter portion 11*c* toward the stepped portion 11*d*'s side, and which is fixed on the outer circumference of small diameter portion 11*c* by the press fit. Moreover, base portion 17 of this cover plate 22 is abutted on the second end surface of inner wheel 7*a* of bearing 7 in the assembled state (mounted state). An end of press-fit fixing portion 23 is abutted on the side surface of stepped portion 11*d*. That is, this cover plate 22 is fixed on the outer circumference surface of small diameter portion 11*c* by the press fit, and also fixed by being sandwiched by the second end surface of inner wheel 7*a* and the side surface of stepped portion 11*d*.

Accordingly, in this water pump 21 according to the second embodiment, it is possible to attain the effects identical to those of water pump 1 according to the first embodiment. Moreover, cover plate 22 itself is press-fit on the outer circumference surface of small diameter portion 11*c*, and directly fixed on small diameter portion 11*c*. With this, it is possible to tightly fix cover plate 22 relative to cover plate 15 according to the first embodiment which does not have the special fixing means. Accordingly, even when the vibration is generated in pump 21, it is possible to tightly hold the mounted state (assembled state) of cover plate 22. Therefore, it is possible to further effectively suppress the deterioration of the ability of the bearing of bearing 7 and the adverse influence such as the abrasion of second seal member 7*e*.

Figure 6:
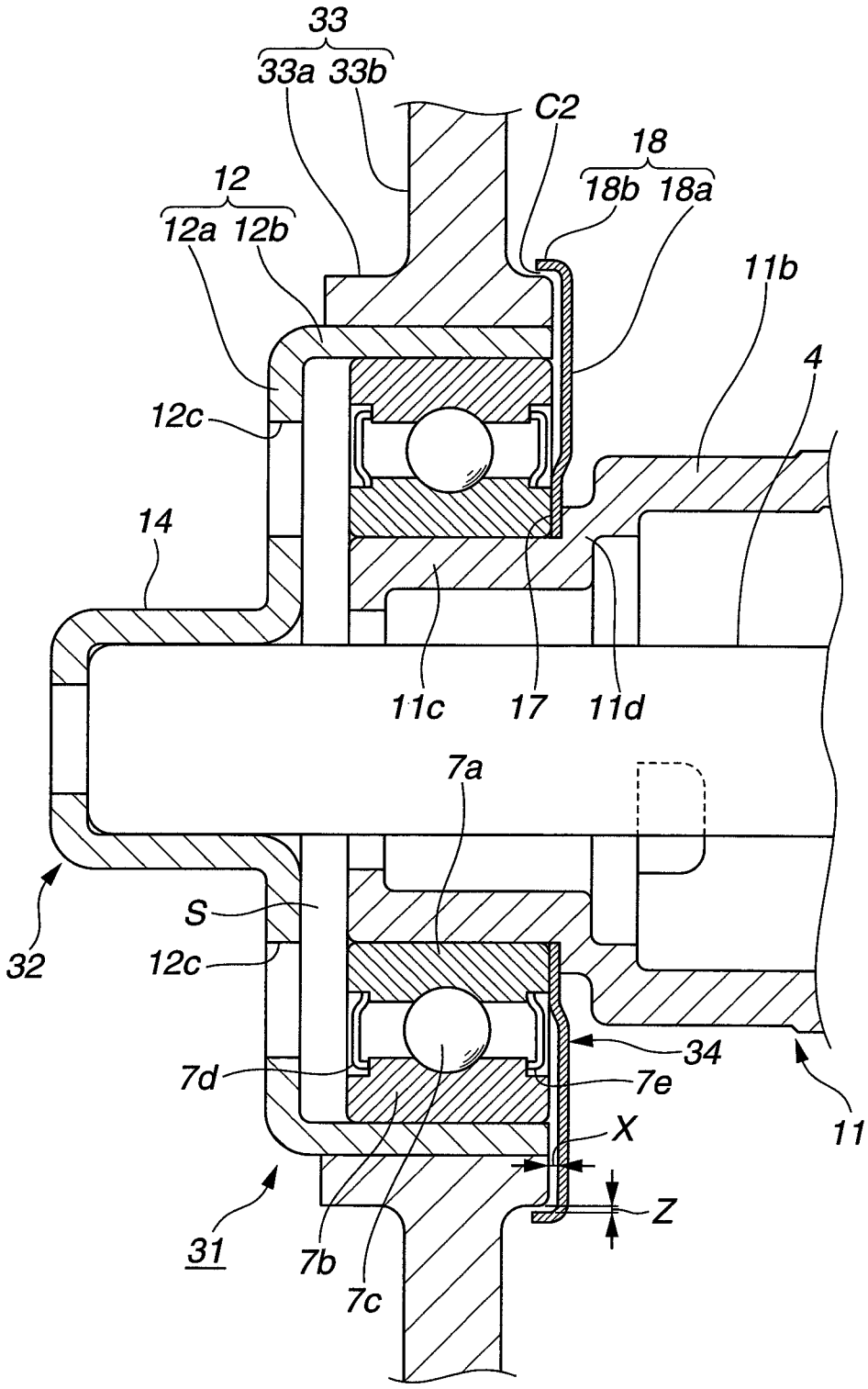
FIG. 6 is an enlarged view showing a main part of a water pump for a vehicle according to a third embodiment of the present invention.

FIG. 6 shows a water pump 31 according to a third embodiment of the present invention. In this water pump 31 according to the third embodiment, a shape of a pulley 32 is changed relative to the shape of pulley 6 of water pump 1 according to the first embodiment. Moreover, a shape of a cover plate 34 is changed in accordance with the change of the shape of pulley 32, relative to cover plate 15 of water pump 1 according to the first embodiment. Structures of water pump 31 other than pulley 32 and cover plate 34 are substantially identical to water pump 1 according to the first embodiment in most aspects as shown by the use of the same reference numerals.

That is, in pulley 32, a shape of a belt winding portion 33 is changed relative to pulley 6 of water pump 1 according to the first embodiment. Belt winding portion 33 of pulley 32 includes a cylindrical portion 33*a* connected with the outer circumference surface of first axial extension portion 12*b*; a second radial extension portion 33*b* which has a substantially flange shape, which is connected with an outer circumference surface of cylindrical portion 33*a*, and which extends in the radial direction from the outer circumference surface of cylindrical portion 33*a*; and a second axial extension portion (not shown) which is connected with an end portion of second radial extension portion 33*b*, and which extends in the axial direction from the end portion of second radial extension portion 33*b*. In pulley 32, cylindrical portion 33*a*, second radial extension portion 33*b*, and the second axial extension portion are integrally formed. The belt is wound around the outer circumference of the second axial extension portion. With this, the rotational driving force is transmitted from the crank shaft to pulley 32.

Base portion 17 of cover plate 34 is sandwiched and fixed between the second end surface of inner wheel 7*a* of bearing 7 and the side surface of stepped portion 11*d* of pump housing 3. Moreover, cover plate 34 includes a separating portion 18 formed on the outer circumference side (radially outer side) of base portion 17. Second separating portion 18*b* on the outermost circumference portion is bent along the shape of pulley 32, like the first embodiment. In cover plate 34, first separating portion 18*a* extends in the radial direction to a portion radially outside a first end portion of cylindrical portion 33*a* which is on the impeller 5's side, that corresponds to an outer circumference portion of first axial extension portion 12*b*. Second separating portion 18*b* is formed at an outer circumference end of first separating portion 18*a*. Second separating portion 18*b* is formed by bending at the right angle relative to first separating portion 18*a* toward the bearing 7's side along the shape of the outer circumference surface of the first end portion (on the right side of FIG. 6) of cylindrical portion 33*a*. Second separating portion 18*b* is formed to extend substantially parallel to the outer circumference surface of the first end portion of cylindrical portion 33*a*. With this, first separating portion 18*a* is arranged to keep a predetermined separating distance X with respect to bearing 7 and pulley 32. Second separating portion 18*b* is arranged to keep a predetermined radial distance Z with respect to pulley 32.

Accordingly, in this water pump 31 according to the third embodiment, it is possible to attain the effects identical to those of the water pump according to the first embodiment. Moreover, in cover plate 34, second separating portion 18*b* is formed by bending on the bearing 7's side (the left side of FIG. 6) along the shape of the first end portion of cylindrical portion 33*a*. With this, it is possible to decrease radial clearance C2 formed between second separating portion 18*b* and the outer circumference surface of the first end portion of cylindrical portion 33*a*. Accordingly, it is possible to open radial clearance C2 to the bearing 7's side which is opposite to the impeller 5's side, in place of opening radial clearance C2 to the impeller 5's side on which the rainwater and so on tends to enter. With this, it is possible to further effectively suppress the rainwater and so on from entering through radial clearance C2. Therefore, it is possible to further improve the endurance of second seal member 7*e*.

The present invention is not limited to the structures of the embodiments. For example, the shape of pump housing 3 and the shape of impeller 5 may be arbitrary changed in accordance with specifications of pumps 1, 21 and 31 according to the above-described embodiments.

In the above-described embodiments, cover plate 15 is disposed on the second end side of bearing 7 on which the rainwater and so on tends to enter. However, cover plates 15 may be disposed on the both end sides of bearing 7. On the first end side of bearing 7, when the water such as the rainwater enters space S through through holes 12*c* of pulley 6, the water may be adhered to (on) first seal member 7*d*. However, pulley 6 is constantly rotated except for the stop of the engine, and the water infrequently enters space S through through holes 12*c* when the pulley is rotated. Accordingly, it is not indispensable that cover plate 15 is disposed on the first end side of bearing 7, relative to the second end side of bearing 7. However, when cover plate 15 is also disposed on the first end side of bearing 7, it is possible to improve the endurance of bearing 7.

Moreover, in the above-described embodiments, cover plates 15, 22 and 34 are made of the metal sheet. However, cover plates 15, 22 and 34 may be made of resin material. In this case, it is also possible to attain the effects identical to the above-described embodiments.

In the above-described embodiments, cover plate 15 is disposed on the second end side of bearing 7. These structures are applicable to an equipment which is other than oil pumps 1, 21 and 31 according to the embodiments, and which has a bearing structure that is exposed to the outside, and that the water may enters directly.

A water pump for a vehicle according to the present invention includes: a pump housing (3); a drive shaft (4) which is inserted into the pump housing (3), and which includes an axial portion surrounded by the pump housing; an impeller (5) fixed on a first end portion of the drive shaft (4), and arranged to discharge a fluid sucked from an axial direction, in a radial direction by rotating by a centrifugal force; a pulley (6, 32) arranged to transmit a rotational driving force from an outside to the drive shaft (4), the pulley (6) including; a fixing portion (14) fixed on a second end portion of the drive shaft (4), a first radial extension portion (12*a*) which is connected with the fixing portion (14), and which extends radially outside the drive shaft (4), and a first axial extension portion (12*b*) which is connected with the first radial extension portion (12*a*), and which extends in the axial direction toward the first end side of the drive shaft (4); a seal ball bearing (7) which is disposed between an inner circumference surface of the first axial extension portion (12*a*) and an outer circumference surface of a cylindrical portion (11*a*) that is formed at a first end portion of the pump housing (3), and that confronts the inner circumference surface of the first axial extension portion (12*a*), and which includes seal members (7*d*, 7*e*) located at both axial ends of the seal ball bearing (7) in the axial direction, and arranged to liquid-tightly seal an inside of the seal ball bearing (7); and a plate member (15, 22, 34) disposed between an end portion of the seal ball bearing (7) which is on an impeller side and a stepped portion (11*d*) which is adjacent to the cylindrical portion (11), and arranged to cover an end surface of the seal ball bearing (7) which is on the impeller side, the plate member (15, 22, 34) having a thickness smaller than a thickness of the stepped portion (11*d*), and including a separating portion (18) which is separated from a portion rotating relative to the plate member (15, 22, 34).

Accordingly, the seal member of the seal ball bearing is not exposed directly to the rainwater and so on by providing the plate member. With this, it is possible to suppress the rainwater and so on from adhering to the seal member. Consequently, it is possible to improve the endurance of the seal member of the seal ball bearing. Moreover, the plate member is thin. Accordingly, it is possible to readily manufacture the plate member, and to suppress the increase of the axial length (size) of the pump.

Moreover, the plate member includes the separating portion. Accordingly, it is possible to suppress the contact between the plate member and the portions rotating relative to the plate member by the separating portion while the plate member is thin. Therefore, it is possible to prevent the decrease (the deterioration) of the bearing ability of the bearing and the decrease (the deterioration) of the endurance of the bearing.

In the water pump according to the embodiments of the present invention, the plate member (15, 22, 34) includes an outermost circumference portion formed along a shape of the pulley (6, 32).

Accordingly, the plate member includes the separating portion so as to form the clearance between the plate member and the pulley. The plate member extends along the shape of the pulley. Accordingly, it is possible to decrease the clearance. Therefore, it is possible to suppress the rainwater and so on from entering through the clearance, and to improve the shut-off effect of the rainwater and so on by the plate member.

In the water pump according to the embodiments of the present invention, the outermost circumference portion of the plate member (15, 22) is formed by bending in the axial direction; and the outermost circumference portion of the plate member (15, 22) extends along the inner circumference surface of the first axial extension portion (12*b*).

Accordingly, the outermost circumference portion of the plate member does not extend perpendicular to the inner circumference surface of the first axial extension portion. The outermost circumference portion of the plate member is formed by bending in the axial direction along the inner circumference surface of the first axial extension portion. With this, it is possible to increase (lengthen) the axial length of the radial clearance formed between the outermost circumference portion of the plate member and the inner circumference surface of the first axial extension portion. Therefore, it is possible to further effectively suppress the rainwater and so on from entering from the radial clearance.

Moreover, the outermost circumference portion of the plate member having the small thickness is bent. With this, it is possible to increase the rigidity of the plate member, and to suppress the deformation of the plate member.

In the water pump according to the embodiments of the present invention, the outermost circumference portion of the plate member (34) is formed by bending in the axial direction in a direction opposite to a direction in which the separating portion (18) is separated; and the outermost circumference portion of the plate member (34) extends along an outer circumference portion of the first axial extension portion (12*b*).

The outermost circumference portion of the plate member is formed by bending in the axial direction opposite to the separating direction of the separating portion along the outer circumference portion of the first axial extension portion. Accordingly, the radial clearance between the outermost circumference portion of the plate member and the outer circumference portion of the first axial extension portion can be opened on the bearing side opposite to the impeller side on which the rainwater and so on tends to enter. Therefore, it is possible to further effectively suppress the rainwater and so on from entering through the radial clearance.

Moreover, the outermost circumference portion of the plate member having the small thickness is bent. Accordingly, it is possible to increase the rigidity of the plate member, and thereby to suppress the deformation of the plate member.

In the water pump according to the embodiments of the present invention, the plate member (15, 22, 34) is fixed and sandwiched between the end portion of the seal ball bearing (7) which is on the impeller side and the stepped portion (11*d*).

Accordingly, there is no need for a special fixing means for fixing the plate member such as the press-fitting. Therefore, it is possible to improve the workability of the assembling operation (mounting operation) of the pump.

In the water pump according to the embodiments of the present invention, the plate member (22) includes an inner circumference portion (23) which is bent in the axial direction, and which is press-fit on the outer circumference surface of the cylindrical portion (11*a*); and the plate member (22) is abutted and fixed on the end portion of the seal ball bearing (7) which is on the impeller side.

The plate member itself is mounted on the outer circumference of the cylindrical portion by the press fit. Accordingly, it is possible to tightly fix the plate member relative to a case in which the plate member is fixed only by being sandwiched by the bearing and the stepped portion.

In the water pump according to the embodiments of the present invention, the pulley (6) includes a second radial extension portion (13*a*) which is connected with the first axial extension portion (12*b*), and which extends in the radially outward direction from the first axial extension portion (12*b*), and a second axial extension portion (13*b*) which is connected with the second radial extension portion, and which extends in the axial direction from the second radial extension portion (13*a*).

A water pump for a vehicle according to the embodiments of the present invention includes: a driving rotation section (4, 5, 6) including an impeller (5) arranged to discharge a fluid sucked from an axial direction, in a radial direction by rotating by a centrifugal force; a pump housing (3) covering the driving rotation section (4, 5, 6); a seal ball bearing (7) including an inner wheel (7*a*) disposed on one of the driving rotation section (4, 5, 6) and the pump housing (3), an outer wheel (7*b*) disposed on the other of the driving rotation section (4, 5, 6) and the pump housing (3), a plurality of balls (7*c*) disposed between the inner wheel (7*a*) and the outer wheel (7*b*), and arranged to be rolled between the inner wheel (7*a*) and the outer wheel (7*b*), and seal members (7*d*, 7*e*) which are disposed on both axial ends of one of the inner wheel (7*a*) and the outer wheel (7*b*), and which extend in the radial direction toward the other of the inner wheel (7*a*) and the outer wheel (7*b*); and a plate member (15, 22, 34) which is disposed between one of the inner wheel (7*a*) and the outer wheel (7*b*) and the pump housing (3), and which covers at least an end portion of a first end side of the seal ball bearing (7) in the axial direction, the plate member (15, 22, 34) having a thickness smaller than a thickness of a stepped portion (11*d*), and including a separating portion (18) bent to separate the plate member (15, 22, 34) from a portion rotating relative to the plate member (15, 22, 34).

Accordingly, the seal member of the seal ball bearing is not exposed to the rainwater and so on by providing the plate member. With this, it is possible to suppress the rainwater and so on from adhering to the seal member. Consequently, it is possible to improve the endurance of the seal member of the seal ball bearing. Moreover, the plate member is thin. Therefore, it is possible to readily manufacture the plate member, and to suppress the increase of the axial length (size) of the pump.

Moreover, the plate member includes the separating portion. With this, it is possible to suppress the contact between the plate member and the portion rotating relative to the plate member by the separating portion while the plate member is thin. Therefore, it is possible to prevent the decrease (deterioration) of the bearing ability of the bearing and the decrease (deterioration) of the endurance of the bearing.

In the water pump according to the embodiments of the present invention, the inner wheel (7*a*) is disposed on the pump housing; and the outer wheel (7*b*) is disposed on the driving rotation section.

In the water pump according to the embodiments of the present invention, the seal members (7*d*, 7*e*) are fixed on the outer wheel (7*b*); and the seal members (7*d*, 7*e*) are rotated relative to the inner wheel.

In the water pump according to the embodiments of the present invention, the plate member (15, 22, 34) is fixed on the inner wheel (7*a*).

The plate member is fixed on the inner wheel. On the other hand, the seal member is fixed on the outer wheel. Accordingly, the plate member and the seal member are alternatively disposed in the axial direction. Consequently, the flow passage for the rainwater and so on has a labyrinth structure. Therefore, it is possible to further effectively suppress the rainwater and so on from entering the inside of the bearing.

In the water pump according to the embodiments of the present invention, the seal ball bearing (7) includes a receiving portion in which the balls are received, which is sealed by the seal members (7*d*, 7*e*), and which receives a grease.

Accordingly, it is possible to decrease the friction between the both wheels of the bearing and the balls, and to prevent trouble or failure such as the seizing and so on of the bearing.

The entire contents of Japanese Patent Application No. 2009-287886 filed Dec. 18, 2009 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A water pump for a vehicle, the water pump comprising:

a pump housing;

a drive shaft which is inserted into the pump housing, and which includes an axial portion surrounded by the pump housing;

an impeller fixed on a first end portion of the drive shaft, and arranged to discharge a fluid sucked from an axial direction, in a radial direction by rotating by a centrifugal force;

a pulley arranged to transmit a rotational driving force from an outside to the drive shaft, the pulley including;

a fixing portion fixed on a second end portion of the drive shaft, a first radial extension portion which is connected with the fixing portion, and which extends radially outside the drive shaft, and a first axial extension portion which is connected with the first radial extension portion, and which extends in the axial direction toward the first end side of the drive shaft;

a seal ball bearing which is disposed between an inner circumference surface of the first axial extension portion and an outer circumference surface of a cylindrical portion that is formed at a first end portion of the pump housing, and that confronts the inner circumference surface of the first axial extension portion, and which includes seal members located at both axial ends of the seal ball bearing in the axial direction, and arranged to liquid-tightly seal an inside of the seal ball bearing; and a plate member disposed between an end portion of the seal ball bearing which is on an impeller side and a stepped portion which is adjacent to the cylindrical portion, and arranged to cover an end surface of the seal ball bearing which is on the impeller side, the plate member having a thickness smaller than a thickness of the stepped portion, and including a separating portion which is separated from the end portion of the seal ball bearing;

wherein the plate member includes an outermost circumference portion formed by bending in the axial direction; and the outermost circumference portion of the plate member extends along an extension direction of the first axial extension portion.

2. The water pump as defined in claim 1, wherein the outermost circumference portion of the plate member extends along the inner circumference surface of the first axial extension portion.

3. The water pump as defined in claim 1, wherein the outermost circumference portion of the plate member is formed by bending in the axial direction in a direction opposite to a direction in which the separating portion is separated from the end portion of the seal ball bearing; and the outermost circumference portion of the plate member extends along an outer circumference portion of the first axial extension portion.

4. The water pump as defined in claim 1, wherein the plate member is fixed and sandwiched between the end portion of the seal ball bearing which is on the impeller side and the stepped portion.

5. The water pump as defined in claim 1, wherein the plate member includes an inner circumference portion which is bent in the axial direction, and which is press-fit on the outer circumference surface of the cylindrical portion; and the plate member is abutted and fixed on the end portion of the seal ball bearing which is on the impeller side.

6. The water pump as defined in claim 1, wherein the pulley includes a second radial extension portion which is connected with the first axial extension portion, and which extends in the radially outward direction from the first axial extension portion, and a second axial extension portion which is connected with the second radial extension portion, and which extends in the axial direction from the second radial extension portion.

7. A water pump for a vehicle, the water pump comprising:

a driving rotation section including an impeller arranged to discharge a fluid sucked from an axial direction, in a radial direction by rotating by a centrifugal force;

a pump housing covering the driving rotation section;

a seal ball bearing including an inner wheel disposed on one of the driving rotation section and the pump housing, an outer wheel disposed on the other of the driving rotation section and the pump housing, a plurality of balls disposed between the inner wheel and the outer wheel, and arranged to be rolled between the inner wheel and the outer wheel, and seal members which are disposed on both axial ends of one of the inner wheel and the outer wheel, and which extend in the radial direction toward the other of the inner wheel and the outer wheel; and a plate member which is disposed between one of the inner wheel and the outer wheel and the pump housing, and which covers at least an end portion of a first end side of the seal ball bearing in the axial direction, the plate member having a thickness smaller than a thickness of a stepped portion provided to the pump housing, and including a separating portion bent to separate the plate member from the end portion of the seal ball bearing, wherein the plate member includes an outermost circumference portion formed by bending in the axial direction; and the outermost circumference portion of the plate member extends along an extension direction of the driving rotation section.

8. The water pump as defined in claim 7, wherein the inner wheel is disposed on the pump housing; and the outer wheel is disposed on the driving rotation section.

9. The water pump as defined in claim 8, wherein the seal members are fixed on the outer wheel; and the seal members are rotated relative to the inner wheel.

10. The water pump as defined in claim 9, wherein the plate member is fixed on the inner wheel.

11. The water pump as defined in claim 7, wherein the seal ball bearing includes a receiving portion in which the balls are received, which is sealed by the seal members, and which receives a grease.

12. A bearing structure comprising:

an inner wheel disposed on one of a first cylindrical member and a second cylindrical member;

an outer wheel disposed on the other of the first cylindrical member and the second cylindrical member;

a plurality of balls disposed between the inner wheel and the outer wheel, and arranged to be rolled between the inner wheel and the outer wheel;

seal members which are disposed on both axial ends of one of the inner wheel and the outer wheel, and which extend in the radial direction toward the other of the inner wheel and the outer wheel; and a plate member which covers at least an end portion on one end side of the axial direction between the inner wheel and one of the first cylindrical member and the second cylindrical member, and which is separated from the outer wheel and the seal member, wherein the plate member includes an outermost circumference portion formed by bending in the axial direction; and the outermost circumference portion of the plate member extends along the other of the first cylindrical member and the second cylindrical member.

* * * * *